US005169616A

United States Patent [19]

Ross

[11] Patent Number: 5,169,616

[45] Date of Patent: Dec. 8, 1992

[54] HIGH THERMAL CONDUCTIVITY CARBON FIBERS

[75] Inventor: Roger A. Ross, Chattanooga, Tenn.

[73] Assignee: E.I. du Pont de Nemours and Company, Wilmington, Del.

[21] Appl. No.: 635,916

[22] Filed: Dec. 28, 1990

[51] Int. Cl.[5] ..... D01F 9/12; C01B 31/04

[52] U.S. Cl. ..... 423/447.1; 264/29.2; 423/447.2; 423/448

[58] Field of Search ..... 423/447.1, 447.2, 445, 423/449, 448; 264/29.1, 29.2, 211.11, 177.11, 108

[56] References Cited

U.S. PATENT DOCUMENTS

| | | | |
|---|---|---|---|
| H907 | 4/1991 | Tate et al. . | |
| 4,005,183 | 1/1977 | Singer | 423/447.2 |
| 4,576,811 | 3/1986 | Riggs et al. | 423/447.2 |
| 4,814,121 | 3/1989 | Watanabe | 423/447.1 |
| 4,816,202 | 3/1989 | Itoi | 264/29.2 |
| 4,923,648 | 5/1990 | Hara et al. | 264/29.2 |
| 4,983,457 | 1/1991 | Hino et al. | 423/447.2 |
| 5,037,589 | 8/1991 | Iwashita et al. | 264/29.2 |

FOREIGN PATENT DOCUMENTS

| | | |
|---|---|---|
| 0372931 | 6/1990 | European Pat. Off. . |
| 113827 | 5/1986 | Japan . |
| 112416 | 4/1990 | Japan . |

OTHER PUBLICATIONS

Nakajima et al., "Preparation & Electrical Conductivity of Fluorine Graphite Fiber Intercalation Compound", *Carbon*, vol. 24, No. 3 1986 pp. 343–351.

Carbon, vol. 17, pp. 59–69, 1979, by Bright and Singer.

*Primary Examiner*—Michael Lewis

*Assistant Examiner*—Stephen G. Kalinchak

[57] ABSTRACT

High thermal conductivity mesophase pitch based carbon fibers are made using a spinneret which has a sharply angled tapered region at the inlet to the spinneret capillary.

5 Claims, 3 Drawing Sheets

HIGH THERMAL CONDUCTIVITY CARBON FIBERS

BACKGROUND OF THE INVENTION

This invention relates to high thermal conductivity carbon fibers and a process for producing them.

Many devices in everyday use are required to disperse substantial amounts of heat in order to function effectively. Electronic devices, such as computer circuits, and mechanical devices, such as aircraft brakes, are two examples. Carbon fibers have long been recognized as excellent conductors of heat, but the drive toward miniaturization and the use of advanced composite materials, many of which do not conduct heat efficiently, require still better thermally conductive fibers.

There have been several approaches to improving the conductivity of carbon fibers. In one method, carbon fibers are given a post-graphitization annealing step. See commonly assigned U.S. Ser. No. 07/491,582. The annealing involves relatively mild heating after graphitization. A fiber having a thermal conductivity of 740 watts/mK is exemplified.

European Patent Application 0 372931, published Jun. 13, 1990, reports examples achieving electrical resistivities as low as 1.15 micro ohm meters which is believed to correspond to a thermal conductivity of about 910 watts/mK. The European Application describes extreme measures to maximize density as the route to achieving maximum conductivities. To maximize the density, the fibers are heated to high temperatures, in the range of 3200 to 3521 degrees Celsius, for very long periods, from one to two hours, an expensive operation.

This invention also focuses on obtaining fibers with high densities and high conductivities. However, rather than trying to densify the fiber after it is formed, this invention provides a process in which the texture and microstructure of the fiber is controlled during the formation of the fiber to result in high density, high conductivity fibers without requiring extreme conditions and lengthy times during graphitization. The high densities and high conductivities of the fibers produced by the process of this invention are achieved by making the texture of the fibers as radial in character as possible, and by forming a fiber with a microstructure that is as highly susceptible to forming aligned graphitic planes as possible. Thus the process of this invention achieves high densities and conductivities not by forcing unaligned graphite planes together after formation, but by aligning the planes so they fit together compactly from the outset.

It is well recognized in the art that radial texture in carbon fibers leads to axial cracking, sometimes called "pacman" formation. However the prior art that has dealt with this phenomenon has been devoted to the minimization or total avoidance of the pacman or axial cracks. The cracking was viewed as a barrier to achieving optimum strength in carbon fibers because the regions exhibiting such cracks were thought to be where tensile failures tended to occur.

There are many prior art teachings relating to minimization of the formation of pacman cracks. See, for example, commonly assigned application EP 0383339 which teaches a particular configuration for disruption of the flow of pitch at the entry to the spinneret as a means of avoiding radial structure and axial cracks.

Another reference is Riggs and Redick, U.S. Pat. No. 4,567,811, also commonly assigned. This patent does not specifically mention the formation of axial cracks due to radial texture in carbon fibers, but teaches spinneret geometries selected for the purpose of optimizing fiber strength While there have been many who have attempted to avoid radial texture and resulting crack formation, there has been no teaching that recognized that radial crack formation was really a process through which the fiber density was being increased, and that this could lead to increased thermal conductivity. Further, while many references purport to teach how to reliably avoid formation of radial structure in carbon fibers, no reference has taught how to achieve radial structure so completely that axial cracks form along nearly the entire length of any fiber and so that such cracks which do form are as large as possible.

This invention provides carbon fibers of high densities and high conductivities. These properties are the result of radial fiber texture leading to densification of the fiber by formation of axial cracks, and are also the result of highly aligned and therefore closely packed microstructure of the fibers.

As used in this application, the term conductivity refers to both electrical and thermal conductivity, and it is believed that these properties correlate, so that if an electrical conductivity were specified, a corresponding value of thermal conductivity could be estimated. Similarly, electrical conductivity is the inverse of electrical resistivity, so any resistivity value has its unique electrical conductivity counterpart. While all of these variables are interrelated, and while increased conductivity is the object of this invention, electrical resistivity is the easiest to measure, and therefore, data given and parameters described herein will be in terms of electrical resistivity. Where thermal conductivity values are reported, these will be estimated figures based on electrical resistivity measurements.

SUMMARY OF THE INVENTION

The highly conductive mesophase pitch-based graphitized carbon fibers of this invention have an electrical resistivity of less than 140 micro ohm centimeters and an $L_c$ value of greater than 375 angstroms. Preferred fibers have a resistivity less than 120 micro ohm centimeters and an Lc of greater than 600 angstroms.

The fibers of this invention are produced by spinning molten mesophase pitch through a spinneret with a particular configuration. The spinnerets useful in the process of this invention have an opening through which molten pitch enters the spinneret and a capillary through which the molten pitch is discharged to form fibers. Connecting the opening and the capillary is a tapered transition region. At the point where the transition region connects to the capillary, the angle formed by the sides of the transition region must be a sharp angle. Angles in the range of 5 to 25 degrees are preferred, and angles in the range of 10 to 15 degrees are more preferred.

It is possible that the tapering transition region of the spinneret can include compound angles and even straight sections, but the part of the transition region joining the capillary must be in the form of the frustrum of a cone, with the capillary at the narrow end of the frustrum. It is preferred that the transition region tapers at a constant angle all the way from the opening of the spinneret to the capillary. That is, it is preferred that the entire transition region from the opening to the capillary is in the form of the frustrum of a cone.

The fibers of this invention are useful for incorporation in composite structures which must conduct heat efficiently.

DETAILED DESCRIPTION OF THE INVENTION

Figure 3:
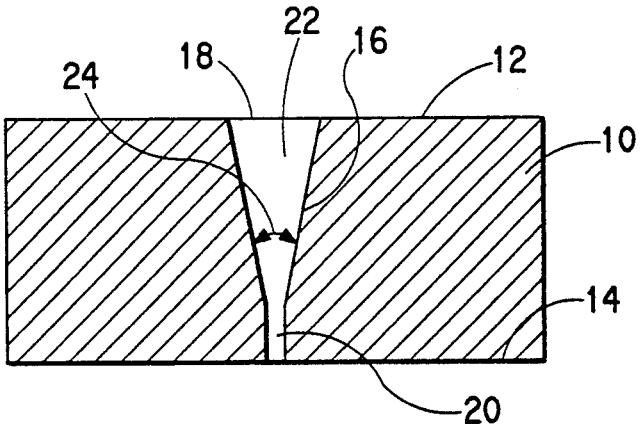
FIG. 3 shows a cross section of a spinneret bore useful in the process of this invention.

The spinneret which is the improvement in the process of this invention can be further explained by referring to FIG. 3. The spinneret 10 is a hard metal body which is relatively thin between its inlet side 12 and outlet side 14. The spinneret has one or more identical bores 16 passing through it. Each bore defines a channel through which molten mesophase pitch is passed to form a carbon fiber. The channel has an opening 18 and a discharge capillary 20. The opening is wider than the capillary. Connecting the opening and the capillary is a tapering transition region 22. In the preferred embodiment shown, the sides of the tapering transition region as seen in this cross section are straight from the opening to the capillary and define a constant angle 24. In other embodiments, the sides of the transition region may exhibit compound angles, vertical portions or non-round cross-sections, but the transition region must be in the form of the frustrum of a cone the sides of which define a sharp angle 24 where the transition region joins the capillary.

The fibers of this invention exhibit an electrical resistivity of less than 140, preferably less than 120 micro ohm centimeters and an $L_c$ value of greater than 375, preferably greater than 600 angstroms. The fibers have a very uniform radial texture which is seen on microscopic examination of the cross section of the fibers, FIGS. 1A and 2A. The fibers are initially circular in cross-section, but during the processing subsequent to spinning, radial cracks are formed which run along the length of the fiber. The fibers made by this process will exhibit such axial cracks in very nearly 100% of the samples observed. This uniformity of crack formation is believed to be due to the uniformity of the radial texture of the fibers.

Figure 1A:
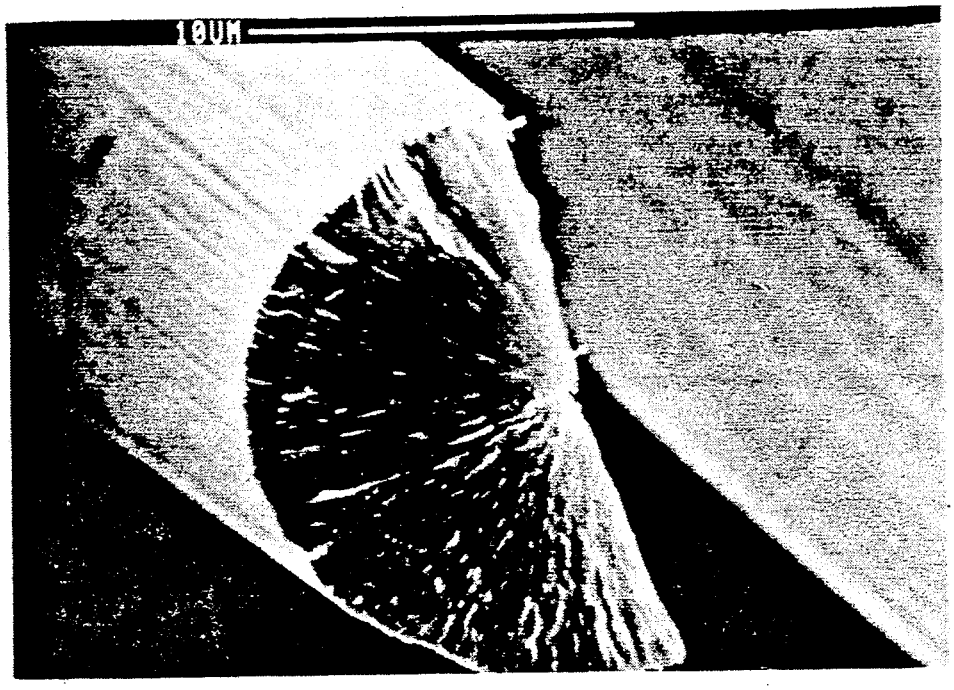
FIG. 1A is a photomicrograph of an end view of a fiber produced in Example 1 showing the highly radial texture and the axial crack which occupies about one half of the original cross-sectional area of the fiber.
Figure 1B:
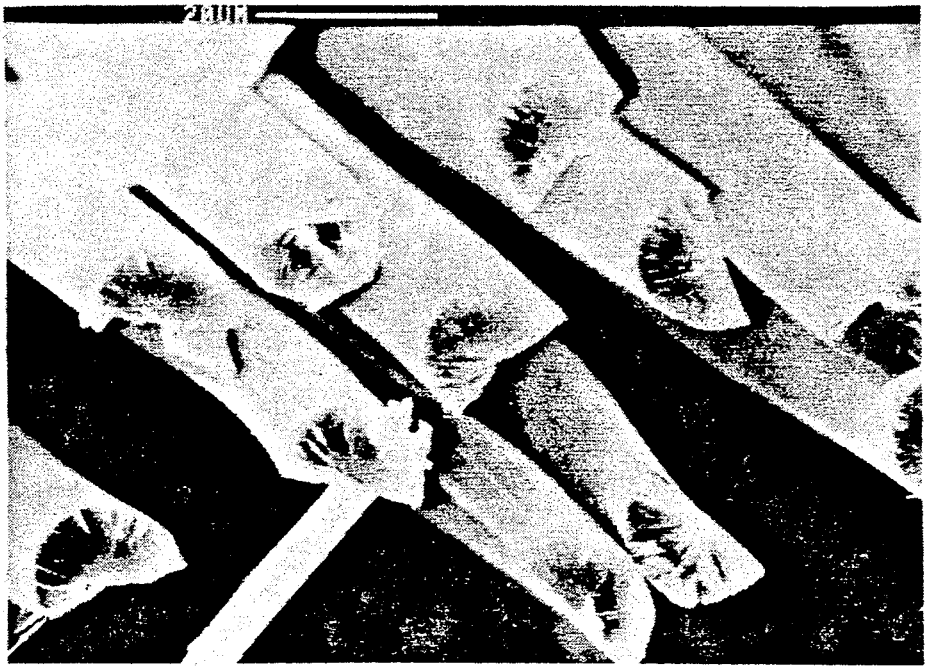
FIG. 1B shows a number of fibers produced in Example 1 all exhibiting radial texture and axial crack formation.
Figure 2A:
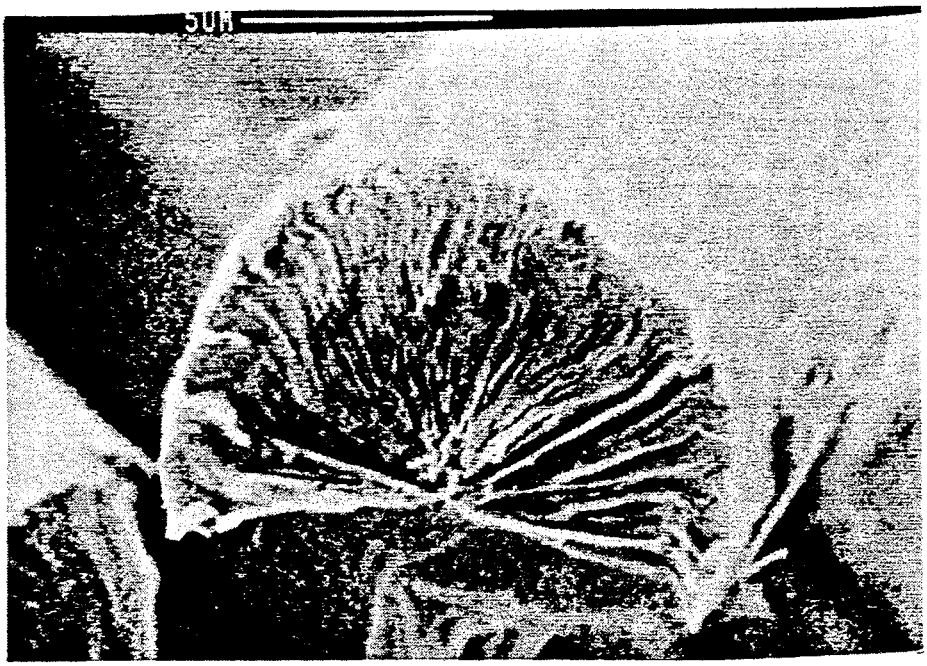
FIGS. 2A and 2B show fibers produced in Example 2.
Figure 2B:
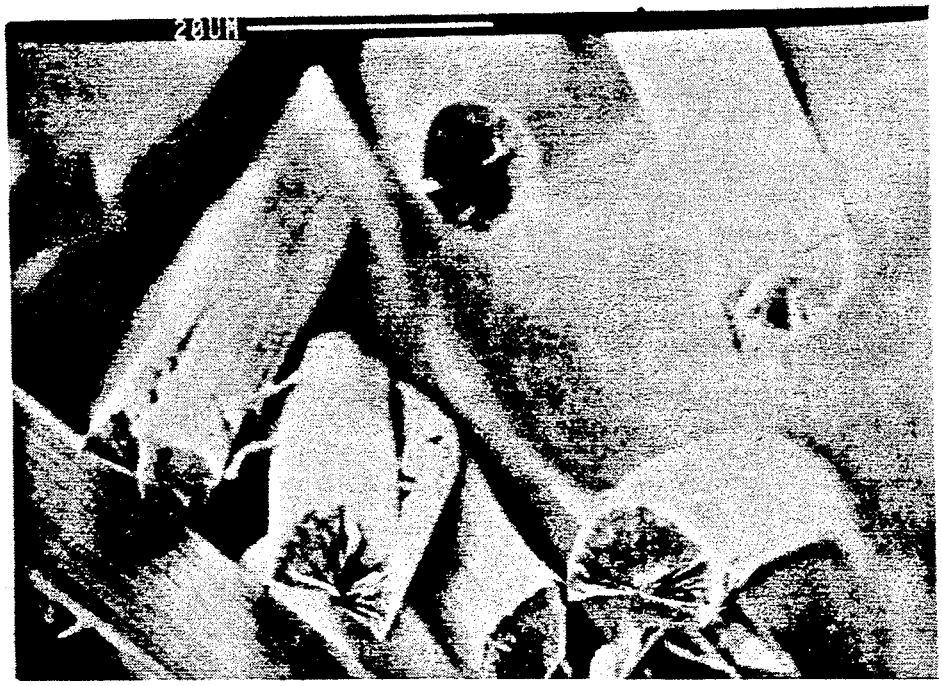

The cracks formed along the axis of the fibers of this invention can be seen in FIGS. 1B and 2B to occupy as much as 180 degrees of the initially circular cross sectional area of the fibers. The maximization of the size of the cracks formed maximizes the density of the fibers. The size of the cracks, and thus the final density and conductivity of the fibers, is believed to be due to the microstructure imparted to the fibers as they are formed. This microstructure permits a high degree of alignment of individual graphitic planes leading to a very dense fiber. The degree of alignment of the graphitic planes is indicated by the value of $L_c$ measured for the fibers. $L_c$ is a measure of the height of the stack of graphitic planes as determined by X-ray diffraction methods.

The $L_c$ measurement procedure is described in U.S. Pat. No. 4,005,183, the disclosure of which is incorporated by reference. More specifically, X-ray analysis is conducted using an area detector system mounted on a conventional generator with Cu K alpha radiation. The distance of the detector is adjusted to optimize the resolution needed for the measurement and frames containing digitized data around the diffraction spot (002) are collected. One dimensional radial and circumferential sections through the center of (002) reflection were made in order to obtain two theta and azimuthal data respectively for analysis. From the two theta scan, it is possible to estimate interplanar spacing, d(002) and average crystallite size, $L_c$. The azimuthal scan is analyzed for calculating orientation distribution function.

The two theta position and full width at half maximum (FWHM) of the diffraction peak are two theta scan. Interplanar spacing is calculated using Bragg's law. FWHM is corrected for the instrumental broadening as, $$B_{corr}=(B_{meas}^2-B_{inst}^2)^{0.5}$$

where $B_{corr}$ is the corrected FWHM, $B_{meas}$ is the measured FWHM and $B_{inst}$ is the instrumental FWHM. Instrumental FWHM was measured from a silicon (111) diffraction peak using a NBS 640b silicon standard. The same diffraction peak is also used for calibrating the position of diffraction peak. Using Sherrer equation and the corrected FWHM, the average crystallite size is estimated. The FWHM of the azimuthal scan is used to define the orientation distribution of the crystallites.

The degree of plane alignment increases as graphitization conditions become more severe. Thus, if graphitization temperatures become higher, or heating times become longer, the value of $L_c$ will rise. However, the high levels of $L_c$ characteristic of the fibers of this invention are obtained without graphitization times or temperatures significantly more severe than graphitization times and temperatures used for conventional carbon fibers.

The method of preparing mesophase pitch for use in the process of this invention is well known in the art. In particular, the disclosures of Lahijani, U.S. Pat. No. 4,915,926, Angier et al., U.S. Pat. No. 4,184,942, Diefendorf et al., U.S. Pat. No. 4,208,267 and Greenwood U.S. Pat. No. 4,277,324 are incorporated by reference.

Spinning is carried out by feeding mesophase pitch, generally in the form of solidified pellets, into a screw extruder and through a spinneret as described above to form fibers. The fibers are quenched in air and collected by conventional means. The spinning rate is generally in the range of 100 to 1000 meters/minute. The as-spun fibers are initially round.

The next step in processing the as-spun or green fibers is stabilization. The method and apparatus of U.S. Pat. No. 4,576,810 are employed. As known in the art, the as-spun fibers are collected in the usual manner on a spinning spool or bobbin. U.S. Pat. No. 4,527,754 illustrates bobbins useful in this operation. A finish, such as a silicone oil finish may be applied to the as-spun fibers prior to winding onto the bobbins.

The fibers on the bobbins are stabilized by heating in air or a mixture of oxygen and an inert gas. The stabilization process is an exothermic oxidation reaction, so care must be taken to prevent the reaction from proceeding too fast and too far. Generally the temperature of the reaction gas is increased in stages to a temperature between 200° and 340° C. The rate at which the temperature is increased will depend on the concentration of the oxygen in the reaction gas and the rate at which the heat generated by the reaction can be transferred from the yarn on the bobbins.

Stabilized carbon fibers are next carbonized, first at a temperature of from 800° to 1000° C. for 0.1 to 1 minute and then at 1000° to 2000° C., preferably 1500° to 1950° C. for about 0.3 to 3 minutes. Carbonization and graphitization both take place in an inert atmosphere. Carbonization can be conducted either as a batch operation on fibers piddled onto a tray which is placed in a closed oven, or as a continuous operation by drawing tows of fibers through long ovens.

Graphitization is carried out on yarn under no tension in a batch operation. Carbonized fibers are heated to about 2400° to 3300°° C., preferably 2600° to 3000° C. Graphitization times are generally at least one minute, but longer times do not appear to be detrimental, either in carbonization or graphitization.

Various electric furnaces may be used for carrying out the graphitization step. Examples are the Tamann electric furnace or the Centorr Associates furnace. The yarns are generally cooled to room temperature after the carbonization step and after the graphitization step.

In the following examples, electrical resistivity measurements were made by measuring the resistance of a filament bundle over a specified distance. This filament bundle was then weighed and the cross-sectional area calculated. Resistivity is the measured resistance times the cross-sectional area divided by the controlled filament bundle length.

Examples

EXAMPLE 1

Midcontinent refinery decant oil was topped to produce an 850° F. plus residue. The residue analyzed 91.8% carbon, 6.5% hydrogen, 35.1% Conradson carbon residue and 81.6% aromatic carbon by C13 NMR. The decant oil residue was heat soaked 6.3 hours at 740° F., and then vacuum deoiled to produce a heat soaked pitch. This pitch tested 106.4% tetrahydrofuran insolubles (1 gram pitch in 20 ml THF at 75° F.).

The pitch so obtained was pulverized, fluxed with toluene (1:1 weight ratio of solvent to pitch) by heating to the reflux temperature for about one hour. The solution was passed through a 1 micron filter, and admixed with sufficient toluene/heptane (79:21) ("anti-solvent") to provide (a) an 81:19 by volume toluene/heptane mixture and (b) an 8:1 mixed solvent/pitch ratio, by volume/weight.

After refluxing for 1 hour, the mixture was cooled to ambient temperature and the precipitated solids were isolated by filtration. The cake was washed with additional anti-solvent followed by heptane and then dried. Several such batches were blended, melted at about 420° C., passed through a 2 micron filter, and extruded into pellets. At this point, the pitch pellets have a quinoline insolubles (ASTM 75° C.) of less than 0.1% by weight and are 100% mesophase, as determined by the polarized light microscopy method.

The resulting pitch had a predicted spin temperature of 348 degrees Celsius. Predicted spin temperature is the temperature at which the pitch exhibits a viscosity of 630 poise, measured using an Instron capillary viscometer.

The pellets were remelted in a nitrogen sparged chamber, and then extruded through a 3 inch 9 hole spinneret. The spinneret was externally heated to result in a spinneret capillary temperature of 350 degrees Celsius. The spinneret holes or bores had a capillary with a length of 32 mils, a diameter of 8 mils, and a transition region which tapered continuously from the 0.1 inch diameter opening of the spinneret to the capillary at an angle of 12 degrees. The spinneret had a total thickness of 0.473 inches. Filaments are wound at 550 yards/minute in an air media on a standard phenolic spool.

The yarn in skeins under no tension was batch stabilized by heating in air. The skeins were heated to 210 degrees Celsius for 48 minutes, then the temperature was increased in stages to 260 degrees and held at that temperature for an additional period of 1.5 hours.

The yarn was carbonized by forwarding the yarn at 4 ft/min through a 4 foot precarbonization oven at 600–800 degrees Celsius, and then through a 9 foot long oven having a 1000–1200 degree entrance zone, a 1600 degree carbonization zone and a 1000–1200 degree exit zone. The exposure time to the highest temperature was 45 seconds. Next the yarn was graphitized by heating to a temperature of 1500 degrees over the period of 1 hour, further raising the temperature to 2982 degrees Celsius over the period of 2 hours 15 minutes, held at 2982 degrees for an additional 10 minutes and then cooled. Both carbonization and graphitization occurred in an inert atmosphere.

Photomicrographs of the yarn are shown in FIG. 1A and 1B, and yarn properties are given in the table.

EXAMPLE 2

Yarn was prepared in the same manner as described in Example 1 except that the spinning temperature was 354 degrees Celsius, and the pitch feed rate was adjusted to produce a fiber of smaller diameter. Photomicrograph of the yarn are shown in FIGS. 2A and 2B, and yarn properties are given in the table.

COMPARATIVE EXAMPLE

Yarn was prepared in the same way as described in Example 1 except that the spinning temperature was 352 degrees Celsius, and the spinneret used had 10 holes and had the same capillary dimensions, but the entrance to the capillary had a compound angle of 60/80 degrees as described in U.S. Pat. No. 4,576,811. Between the tapered portion connecting to the capillary and the opening at the inlet of the spinneret was a straight sided counterbore having a diameter of 0.055 inches. The pitch feed rate was also adjusted to produce a fiber having a smaller diameter than the fiber of Example 1. Fiber properties are given in the table.

TABLE

| | Fiber Diam. Micro-meters | % Fibers Cracked | Crack Angle Deg. | Elect. Resist. Micro ohm cm | $L_c$ Angstr. | Thermal Cond. W/mK |
|---|---|---|---|---|---|---|
| Ex. 1 | 14.4 | 86 | 180 | 112 | 944 | 921 |
| Ex. 2 | 10.9 | 96 | 180 | 115 | 815 | 910 |
| Com. Ex. | 9.9 | 9 | 60 | 194 | 338 | 692 |

I claim:

1. In a process for producing mesophase pitch-based carbon fibers comprising spinning molten mesophase pitch through a spinneret having an opening, a discharge capillary and a tapering transition region extending between said opening and said capillary, the improvement for producing carbon fibers having an electrical resistivity of less than 140 micro ohm centimeters and an $L_c$ value of greater than about 375 angstroms comprising employing a spinneret wherein the tapering transition region at the entrance to the capillary has a sharp angle of from 5 to 25 degrees.

2. The process of claim 1 wherein the fiber has a resistivity of less than 120 micro ohm centimeters and an $L_c$ greater than 600 angstroms.

3. The process of claim 2 wherein the transition region tapers at a constant angle from the opening to the capillary.

4. The process of claim 1 wherein the tapering transition region at the entrance to the capillary has an angle of from 10 to 15 degrees.

5. The process of claim 4 wherein the transition region tapers at a constant angle from the opening to the capillary.

* * * * *